US006044986A

United States Patent [19]

Wood

[11] Patent Number: 6,044,986

[45] Date of Patent: Apr. 4, 2000

[54] WALL MOUNTED DISPLAY FIXTURE SYSTEM

[75] Inventor: Graham Robert Wood, Glencoe, Ill.

[73] Assignee: Stamford Investments, Inc., Wheeling, Ill.

[21] Appl. No.: 09/267,521

[22] Filed: Mar. 12, 1999

[51] Int. Cl.[7] ..... A47F 5/00

[52] U.S. Cl. ..... 211/87.01; 211/90.02; 211/90.04; 211/103

[58] Field of Search ..... 211/103, 90.01, 211/90.02, 90.04, 94.01, 87.01, 105.1, 48, 96; 312/245

[56] References Cited

U.S. PATENT DOCUMENTS

| | | | |
|---|---|---|---|
| 3,814,033 | 6/1974 | Rudat et al. . | |
| 3,875,711 | 4/1975 | Palmer . | |
| 4,205,815 | 6/1980 | Sauer et al. . | |
| 4,832,298 | 5/1989 | Metcalf . | |
| 5,027,962 | 7/1991 | Maccarrone . | |
| 5,292,011 | 3/1994 | Kostigian | 211/103 X |
| 5,305,898 | 4/1994 | Merl | 211/87.01 |
| 5,472,103 | 12/1995 | Merl | 211/90.04 X |
| 5,503,277 | 4/1996 | O'Brien . | |
| 5,641,081 | 6/1997 | Merl | 211/103 |
| 5,697,507 | 12/1997 | Blass | 211/90.01 X |
| 5,758,988 | 6/1998 | Theodorou . | |
| 5,769,247 | 6/1998 | Merl | 211/103 |
| 5,848,711 | 12/1998 | Schmit | 211/90.04 |
| 5,857,577 | 1/1999 | Thomas et al. | 211/94.01 |

*Primary Examiner*—Robert W. Gibson, Jr.
*Attorney, Agent, or Firm*—Welsh & Katz, Ltd.

[57] ABSTRACT

A display fixture system for mounting to an associated surface includes upper and lower of spaced apart, parallel horizontal brackets for mounting to the surface. Each bracket has a securing location corresponding to a securing location of the other of the pair of brackets. The brackets are mounted to the surface so that corresponding securing locations are vertically aligned with one another. Support risers extend between the brackets and are secured to the brackets in a vertical orientation, transverse to the brackets and spaced from the surface. The support risers include a central support post and a pair of parallel flanges extending longitudinally along and parallel to the posts. Pins extend transversely through the support posts, extending between the flanges to join the flanges to the posts. The risers are configured to support product display elements and ornamentation such as shelves, hangers and the like for merchandise display.

15 Claims, 4 Drawing Sheets

WALL MOUNTED DISPLAY FIXTURE SYSTEM

FIELD OF THE INVENTION

This invention pertains to a display fixture. More particularly, the invention pertains to a readily installed wall mounted display fixture system such as those used in retail establishments.

BACKGROUND OF THE INVENTION

Display system are well known in the art. These systems can be used, for example, for retail display of various items such as clothing and the like. Consumers will likely recognize such systems which often include shelves for displaying merchandise and hangers from which items can be displayed or hung. These displays can also include partitions and the like for segregating one particular type of merchandise from another.

One known type of wall display system includes a plurality of vertically oriented, spaced upright posts mounted to the surface or wall. The posts typically include a plurality of evenly spaced elongated slots extending longitudinally therealong. Brackets having hook-like projections extending from a rear end insert into the elongated slots and lock to the posts. The brackets can be used to support shelving, signs, desk surfaces and the like.

One drawback to this type of system is that each of the vertical posts must be separately or independently mounted to the wall surface. While this type of arrangement has gained wide-spread acceptance, it leaves much room for error in layout or design and installation. For example, if adjacent posts are not properly spaced from one another, a shelf that is intended to extend between the posts may be too long or too short for the given installed spacing. In addition, when installing such systems, the height of corresponding slots from one post to an adjacent post must be properly maintained, or the shelf may not rest horizontally planar on the brackets.

Another type of shelving system includes a grid-like arrangement that is mounted to the wall surface. The grid-like arrangement includes a plurality of horizontally extending bars, onto which brackets are attached. While this arrangement overcomes some of the above-noted problems associated with the independent post type of arrangement, the grid-like configuration can be quite large and bulky and, as will be recognized, rather heavy as well. Additionally, the grid-like arrangement, like the independent post arrangement, requires that the grid be mounted to the wall at a large number of locations.

Still another type of display fixture system includes a plurality of essentially free-standing U-shaped vertical standards or uprights. Each of the U-shaped uprights includes a pair of parallel elements, to which shelves and the like can be attached. Although this arrangement provides a significant amount of display space, it is free-standing, and is therefore subject to the instability associated with many such free-standing systems.

Accordingly, there exists a need for a readily installed wall mounted display fixture system. Desirably, such a system is readily installed on any flat wall surface, and is secured to the surface using a minimum number of fasteners. Most desirably, such a system eliminates the possibility of improperly spacing the vertical uprights from one another and provides adjustability of the vertical support risers to maintain spanning elements, such as shelves, horizontal.

SUMMARY OF THE INVENTION

A display fixture system for mounting to an associated surface includes upper and lower, spaced apart, parallel horizontal brackets for mounting to the surface. Each bracket has a securing location that corresponds to a securing location of the other bracket. The brackets are mounted to the surface so that corresponding securing locations are vertically aligned with one another.

Support risers extend between and are secured to the brackets. The risers secure between the brackets vertically, transverse to the brackets and spaced from the wall surface. The risers mount to the upper and lower brackets at securing locations on the brackets.

The display system is configured to support product display elements, such as shelves, display surfaces, signs and hangers to, for example, hang clothing, as well as other types of display ornamentation. The system is flexible and sufficiently versatile that using standard posts and brackets, custom displays can be designed and installed quickly and efficiently, with a minimum number of wall fasteners required.

Each of the support posts inserts into corresponding upper and lower bracket securing locations. The support posts are preferably formed having a central support member, such as a tubular element and a pair of longitudinally extending flanges. Pins insert through transverse openings in the support posts and are fastened to the posts and to the flanges to secure the flanges to the posts. In a most preferred configuration, an upper end of each support post includes a threaded bore or insert to facilitate securing the post to the upper bracket.

The upper and lower brackets each include an opening and a pair of elongated slots disposed on either side of the opening for receiving a support post. The flanges insert into the elongated slots and the post inserts through a relatively large opening in the lower flange. A threaded fastener, such as a bolt, is inserted through the opening in the upper bracket and threadedly engages the insert or bore in the post to secure the post to the upper bracket.

In a most preferred embodiment, the support posts each include a height adjusting element, such as a threaded foot for resting the support post on the floor, and to provide height adjustment so that each support post is vertically aligned with its adjacent posts.

The pins that extend from the support posts to the flanges are configured to receive brackets and other hanging elements for hanging shelves, signs, garment hangers, table tops and the like, as well as other types of display ornamentation. Optionally, the display system can include wall panels that mount to the upper and lower brackets, between adjacent support posts. In one embodiment, the panels include fixed lower pins that extend from a bottom edge of the panel frame and biased upper pins that extend from an upper edge of the panel that insert into openings formed in the upper and lower brackets, respectively.

Other features and advantages of the present invention will be apparent from the following detailed description, in conjunction with the accompanying drawings, and the appended claims.

DETAILED DESCRIPTION OF THE PREFERRED EMBODIMENTS

Figure 1:
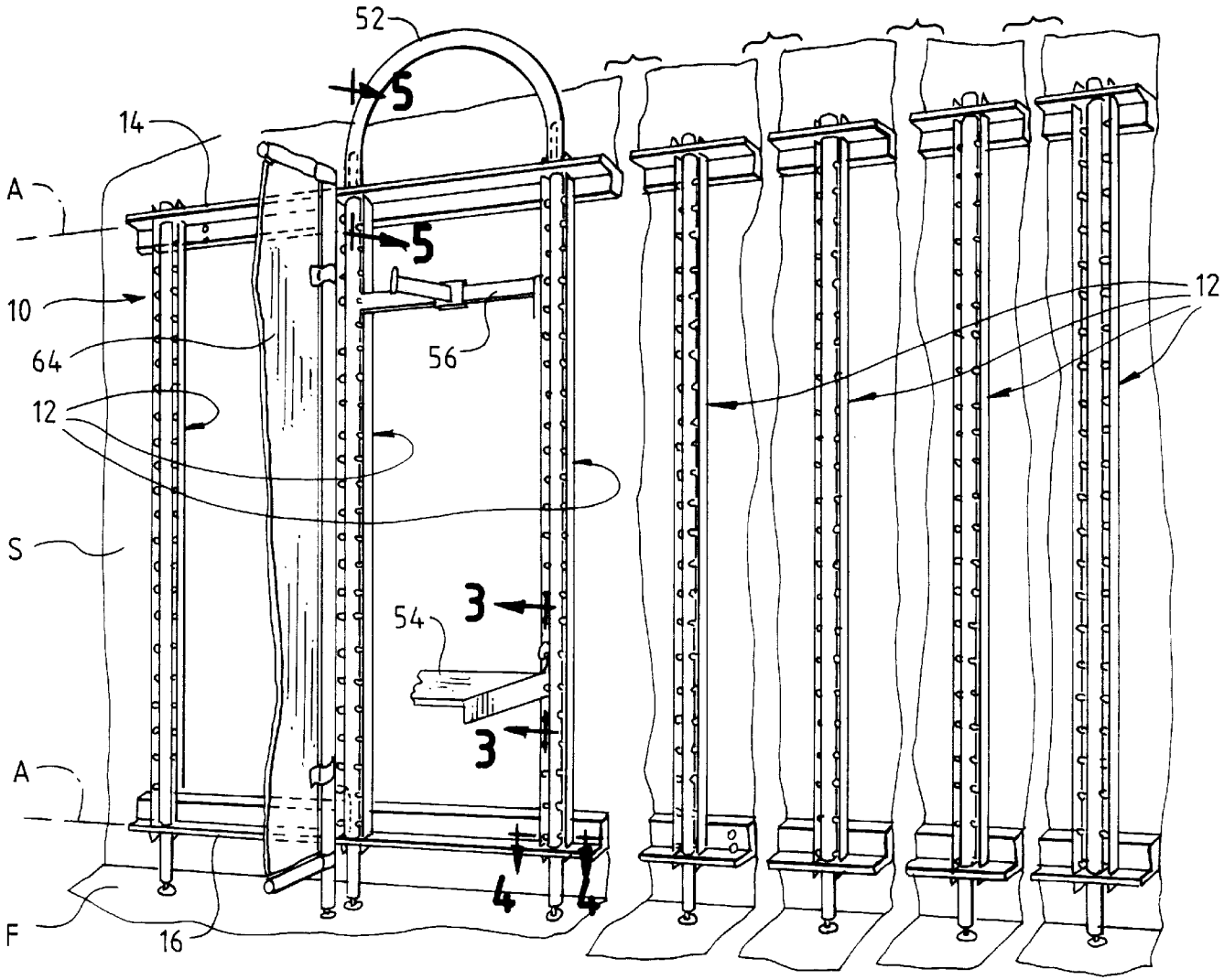
FIG. 1 is a perspective view of a wall mounted display fixture system embodying the principles of the present invention, the system being illustrated in partial view so as to illustrate a plurality of vertical upright posts.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a wall mounted display fixture system 10 embodying the principles of the present invention. This system includes, generally, a plurality of parallel, vertically extending upright support posts 12 secured between and mounted to upper and lower bracket members 14, 16, respectively. The bracket members 14, 16 are adapted to secure the vertical support posts 12 in spaced parallel relation to one another. In a current embodiment, the upper and lower brackets 14, 16 are angle-like members each having a first leg 18 for mounting the bracket 14, 16 to the wall surface S, and a second leg 20 that is configured for receiving the vertical support posts 12. The brackets 14, 16 can be mounted to the wall S by, for example, threaded fasteners such as screws. It will be appreciated by those skilled in the art that the brackets 14, 16 can be formed in a wide variety of configurations, which configurations are within the scope of the present invention.

The lower bracket 16 includes a plurality of relatively large diameter openings 22, each opening 22 having associated therewith a pair of openings, preferably a pair of symmetrically located elongated slots 24 positioned on opposing sides of the larger, central opening 22. The upper bracket 14 includes a plurality of smaller diameter openings 26, each having a pair of openings, preferably a pair of elongated slots 28 associated with each opening 26 positioned on opposing sides of the smaller diameter opening 26. For purposes of the present discussion each opening and its associated elongated slots will be referred to as a securing location, indicated generally at 30 and 32 for the upper and lower brackets 14, 16, respectively. In a preferred configuration, the elongated slots 24, 28 are formed symmetrically in the brackets 14, 16 relative to the openings 22, 26 and extend transverse to a longitudinal axis A of the bracket 14, 16.

Each of the upper and lower securing locations 30, 32 is spaced a predetermined distance from its adjacent securing locations. As will be appreciated from the drawings, spacing each securing location 30, 32 from its adjacent securing locations establishes a predetermined distance between each of the vertical upright support posts 12. In this manner, it is unnecessary to mark or determine vertical support post 12 spacing in that the spacing is established by the distance between each of the securing locations 30, 32. In addition, each upper securing location 30 corresponds to a lower securing location 32, with the larger diameter opening 22 of the lower bracket 16 corresponding to the smaller diameter opening 26 of the upper bracket 14, and the elongated slots 24 of the lower bracket 16, likewise, corresponding to the elongated slots 28 of the upper bracket 14. Each of these upper and lower elements correspond to one another and lie vertically planar with one another.

Each of the vertical upright support posts 12 includes a central elongated support element 34 and a pair of termination flanges 36 extending longitudinally parallel to the support elements 34. Pins 38 extend transversely from the elongated support element 34 at predetermined distances along the elements and secure the flanges 36 to the support elements 34. As such, each of the vertical support posts 12 is a vertical riser having a central support element 34 and a pair of flanges 36 extending parallel to and longitudinally along each of the elements 34 secured thereto by the pins 38. In a preferred arrangement, the riser or support element 34 has openings 40 formed therein through which the pins 38 traverse and are fastened to the flanges 38 and the support element 34 by, for example, welding.

Figure 2:
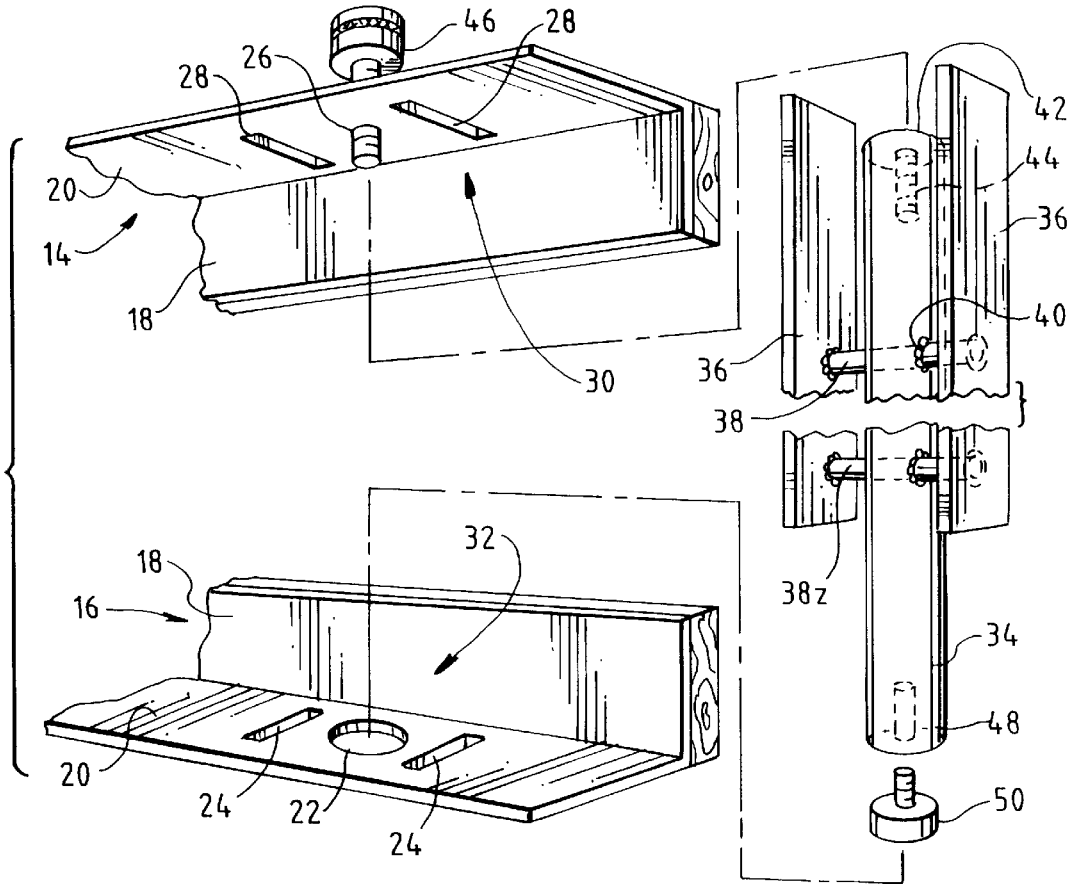
FIG. 2 is a partial exploded perspective view of one vertical upright support post, illustrated as the support post inserts into and secures to the upper and lower brackets.

Referring now to FIG. 2, the flanges 36 extend along each support post 12, at the top, to a position slightly beyond (i.e., above) that of the end 42 of the support element 34. That is, the flanges 36 extend upwardly beyond the end 42 of the support element 34. A threaded bore or insert 44 is formed in the top 42 of the support element 34 to facilitate securing the post 12 to the upper bracket 14. A knurled fastener or bolt 46 threads into the bore 44 to secure the post 12 to the upper bracket 14.

The lower end of the support post 12 is configured in a converse manner to the upper end. The elongated support element 34 extends beyond the lower end of the flanges 36, as shown generally at 48. In addition, the last transverse pin 38*z* that secures the flanges 36 to the support element 34 is spaced from the end of the flanges 36. In this manner, a portion of each of the flanges 36 extends beyond the last transverse pin 38*z* but not to the lower end of the support element 34. In a preferred arrangement, a height adjusting element 50, such as the exemplary threaded foot extends from the lower end of each support post 12. As will be explained in detail below, the threaded foot 50 permits fine adjustment of the height of the support post 12.

Figure 4:
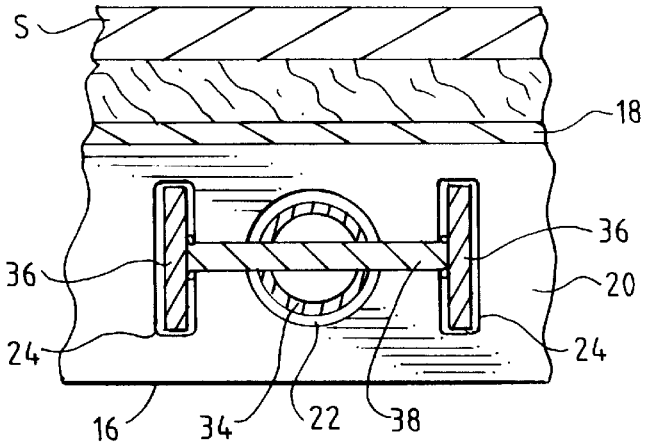
FIG. 4 is a partial cross-sectional view taken along line 4—4 of FIG. 1, and illustrates one exemplary vertical upright support post positioned within the lower bracket.

Referring to FIGS. 2 and 4, installation of the wall mounted display system 10 will be readily understood. First, the upper and lower brackets 14, 16 are secured to a surface S, such as a wall. The brackets 14, 16 can be secured to the wall S by mechanical fasteners, such as bolts, screws and the like, which mechanical fastening methods will be recognized by those skilled in the art. In securing the upper and lower brackets 14, 16 to the wall S, the brackets 14, 16 must be secured parallel to one another and spaced a predetermined distance from one another. In addition, a desired distance of the lower bracket 16 from the floor F must also be carefully determined and maintained. In installing the brackets 14, 16, care must also be taken to assure that corresponding upper and lower securing locations 30, 32 are vertically aligned with one another. Essentially, the upper and lower brackets 14, 16 must be parallel to and properly spaced from one another, with the lower bracket 16 properly spaced from the floor F. In addition, corresponding upper and lower securing locations 30, 32 must be vertically aligned with one another.

After the upper and lower brackets 14, 16 are properly located and secured to the wall S, the lower end of the vertical support post 12 is mounted to the lower bracket 16 by inserting the support element 34 through the larger diameter opening 22 in the lower bracket 16. While inserting the support element 34 through the opening 22, the lower ends of the flanges 36 are inserted into the elongated slots 24 located in the bracket 16 on either side of the opening 22.

With the lower portion of the support post 12 positioned in the lower bracket 16, the upper portion of the support post 12 is located and positioned in the upper bracket 14, by inserting the flanges 36 through the elongated slots 28 in the upper bracket 14. The fastener or bolt 46 is then inserted through the smaller diameter opening 26, and is threaded into the bore 44, securing the support post 12 in place. As seen in FIG. 1, when the support post 12 is in place in the brackets 14, 16, it is spaced from the wall S.

The threaded foot 50 is next adjusted by lowering it to rest on the floor F, which transfers any vertical load exerted on the support post 12 to the floor F, rather than on the brackets 14, 16. The remaining support posts 12 are installed between the upper and lower brackets 14, 16 in a similar manner. The threaded foot 50 can be further used to provide fine height adjustment of each support post 12, to assure that each of the transverse pins 38 is on a horizontal plane with corresponding pins 38 of each adjacent support post 12. The threaded foot 50 is also used to adjust post 12 height to assure that spanning elements, such as shelves that extend between support multiple support posts 12, are horizontally oriented and not skewed.

Figure 5:
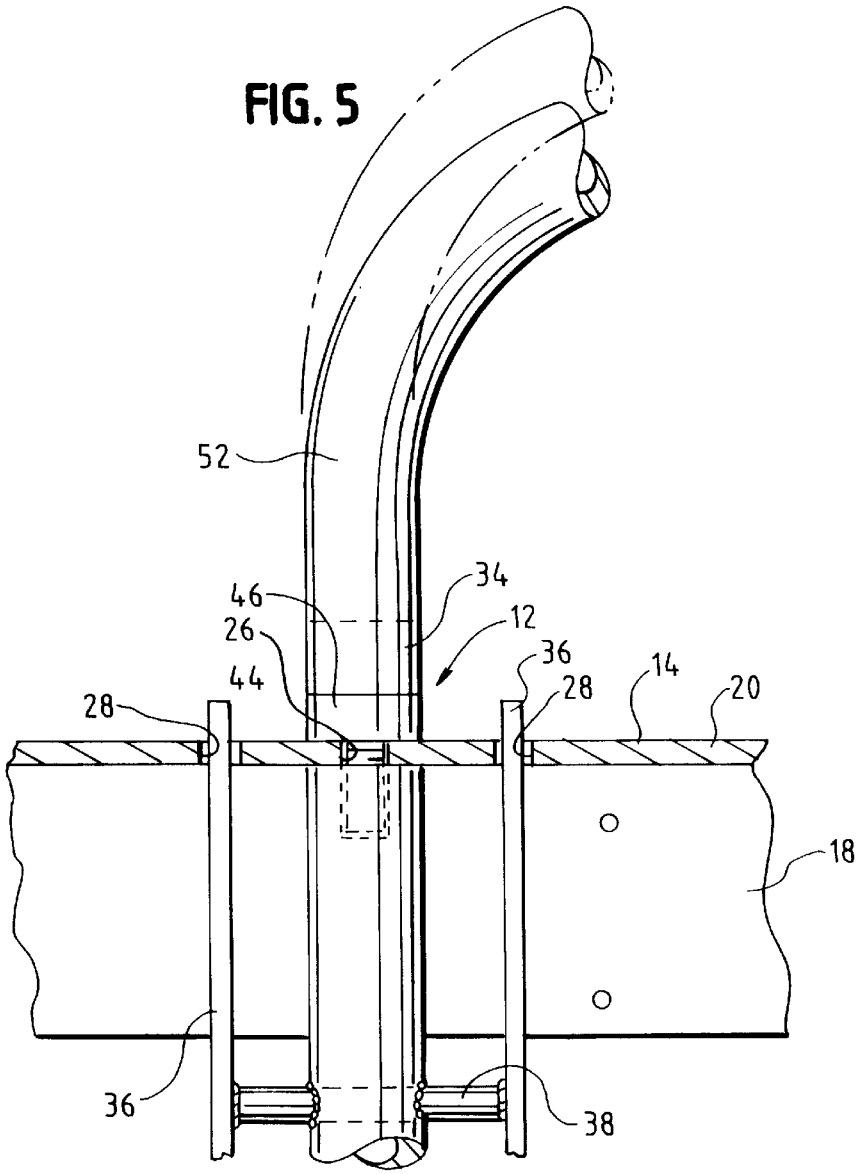
FIG. 5 is a partial cross-section view taken along line 5—5 of FIG. 1, illustrating an exemplary semi-circular header element mounted to the top portion of a vertical upright support post.

A wide variety of product display elements and display ornamentation can be supported from the wall mounted display system 10. For example, as shown in FIGS. 1 and 5, a semi-circular header portion 52 can be used to extend between a pair of adjacent support posts 12. The semi-circular header 52 can be fitted directly into the threaded bore 44 of the support posts 12 or can attach to the bolt 46 using any of a variety of mechanical fastening arrangements.

Figure 3:
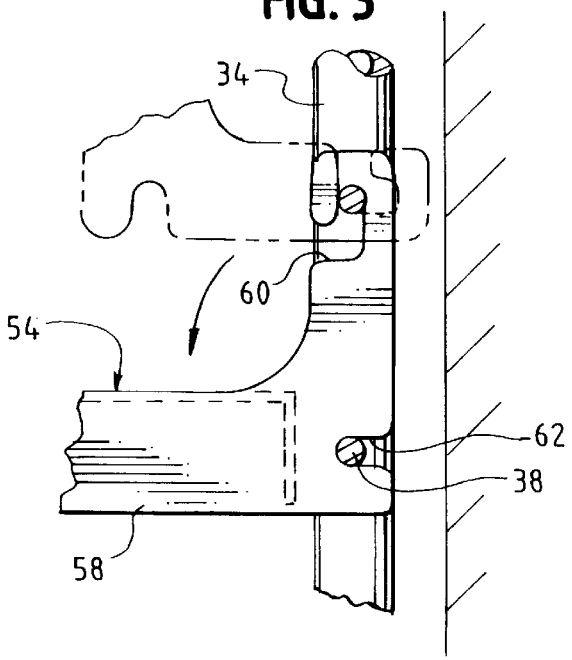
FIG. 3 is a partial cross-sectional view taken along line 3—3 of FIG. 1, and illustrates an exemplary shelf bracket being positioned on one of the vertical upright support posts.

The display system 10 can also support shelves 54 and hangers 56 as illustrated in FIGS. 1 and 3. FIG. 3 illustrates one exemplary arrangement by which a shelf bracket 58 or hanger bracket attaches to the support post 12. The bracket 58 can include a pair of opposingly oriented notches 60, 62 formed in the bracket 58. An upper notch 60 can be formed having an L-shaped opening to lock the notch 60 onto the transverse pins 38. One advantage of the present display system 10 is that the end flanges 36 which are affixed to the pins 38, prevent the bracket 58 from slipping or otherwise dislodging from the pins 38. This additional, lateral securing arrangement provides increased assurance of the structural integrity of the display system 10 and the supported structural elements (e.g., product display elements) that are attached to the system 10, such as shelves 54, hangers 56 and the like. The hanger element 56 secures to the display system 10 in a like manner, and can be used to, for example, hang garments and the like for display.

Other display elements can include, for example, a partition 64 extending from the display system 10, transversely from the wall S. Such a partition 64 can be used to segregate or separate different merchandise or, for example, different sizes of the same merchandise.

Figure 6:
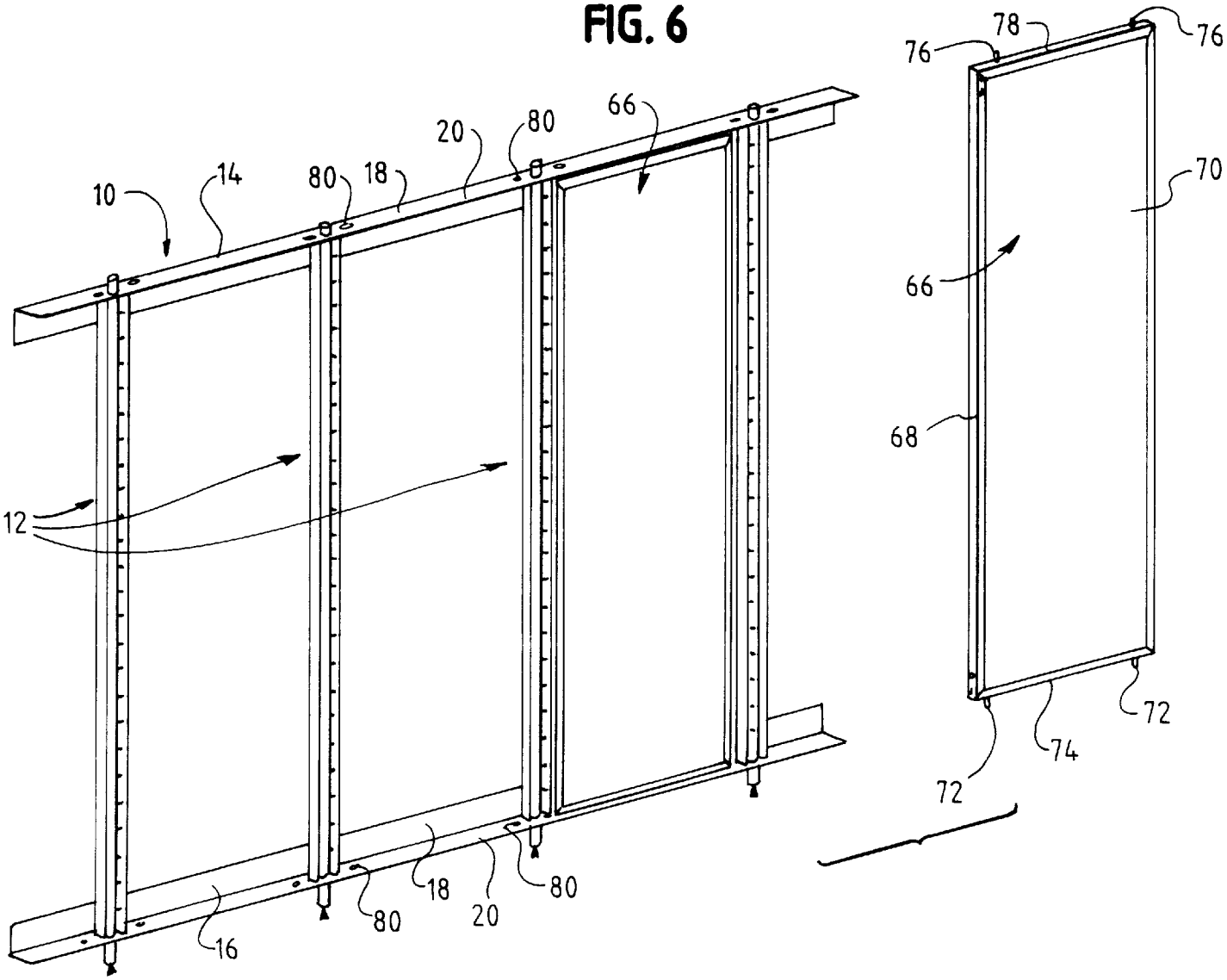
FIG. 6 is a partial perspective view of the wall mounted display system illustrated with an optional wall panel positioned between the upper and lower brackets and between adjacent support posts.

An additional display element includes a wall panel 66 that secures to the upper and lower brackets 14, 16 between adjacent vertical support posts 12, as illustrated in FIG. 6. The panel 66 can be formed having a frame 68 and a central core (not shown) interposed between face sheets 70 (one shown). The face sheets 70 can be formed having different colors or graphics, or can be mirrored, depending upon the design and ornamentation that is desired. In one embodiment, the frame 68 includes fixed lower pins 72 extending from a bottom edge 74 of the frame 68 and biased (e.g., spring-loaded) upper pins 76 extending from an upper edge 78 of the frame 68. The pins 72, 76 insert into openings 80 formed in the upper and lower brackets 14, 16 to secure the panel 66 to the display system 10. The panels 66 provide added flexibility and design potential for the display system 10.

Those skilled in the art will recognize the extreme advantages of the present wall mounted display system 10. The present system 10 provides a readily designed, easily installed and extremely versatile display system 10 that can be used for displaying a wide variety of merchandise. In addition, the present wall mounted display system 10 also provides for easily installing shelving, hangers, desk tops and other product display elements and ornamentation to create custom display arrangements.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A display fixture system for mounting to an associated surface comprising:

upper and lower spaced apart, parallel horizontal brackets for mounting to the surface, the upper bracket having a securing location corresponding to a securing location of the lower bracket, the upper and lower brackets being mounted to the surface so that corresponding securing locations are vertically aligned with one another; and a support riser extending between and secured to the brackets, wherein the support riser includes a bore formed therein for receiving a fastener inserted through the securing location in the upper bracket for securing the support riser to the upper bracket, the riser being secured between the brackets in a vertical orientation, transverse to the brackets and spaced from the surface, the support riser capable of supporting a product display.

2. The display fixture system in accordance with claim 1 including a height adjusting element mounted to a lower end of the support riser.

3. The display fixture system in accordance with claim 2 wherein the height adjusting element is a foot mounted to a threaded rod for threading into an opening in a bottom end of the support riser.

4. A display fixture system for mounting to an associated surface comprising:

a pair of spaced apart parallel horizontal brackets for mounting to the surface, each bracket having a securing location corresponding to a securing location of the other of the pair of brackets, wherein each of the securing locations includes an opening and a pair of elongated slots disposed on either of opposing sides of the opening, the brackets being mounted to the surface so that corresponding securing locations are vertically aligned with one another; and a support riser extending between and secured to the brackets, the riser being secured between the brackets in a vertical orientation, transverse to the brackets and spaced from the surface, the support riser capable of supporting a product display, wherein the support riser includes a pair of flanges extending longitudinally parallel thereto, the riser being configured for receipt in the opening of the securing location and the flanges being configured for receipt in the elongated slots of the securing, location.

5. The display fixture system in accordance with claim 4 wherein the elongated slots are disposed symmetrically relative to the opening.

6. The display fixture system in accordance with claim 5 wherein the elongated slots are disposed transverse to a longitudinal axis of the lower bracket.

7. The display fixture system in accordance with claim 6 wherein the support riser includes a bore formed therein for receiving a fastener inserted through the opening in the upper bracket for securing the support riser to the upper bracket.

8. The display fixture system in accordance with claim 7 including a height adjusting element mounted to the support riser.

9. A display fixture system for mounting to an associated vertical surface, above a floor, comprising:

upper and lower spaced apart, parallel horizontal brackets for mounting to the surface, the upper bracket having a securing location vertically aligned with and corresponding to an opening in the lower bracket, the lower bracket being mounted to the surface above the floor; and a vertical support riser extending from the floor, through the opening in the lower bracket and secured to the upper bracket, the riser being secured between the brackets in a vertical orientation, transverse to the brackets and spaced from the surface, thereby being capable of supporting product displays and ornamentation.

10. The display fixture system in accordance with claim 9 including a height adjusting element mounted to a lower end of the support riser.

11. The display fixture system in accordance with claim 10 wherein the upper securing location includes an opening and a pair of elongated slots disposed on either of opposing sides of the opening, and wherein the opening in the lower bracket includes a pair of elongated slots disposed on ether side of the opening corresponding to the elongated slots of the upper securing location, and wherein the support riser includes a pair of flanges extending longitudinally therealong, the riser being configured for receipt in the lower bracket opening and the flanges being configured for receipt in the elongated slots.

12. The display fixture system in accordance with claim 11 wherein the support riser includes a bore formed therein for receiving a fastener inserted through the opening in the upper bracket for securing the support riser to the upper bracket.

13. The display fixture system in accordance with claim 9 wherein the height adjusting element is a foot mounted to a threaded rod for threading into an opening in a bottom end of the support riser.

14. The display fixture system in accordance with claim 9 including a removable panel configured for mounting between the upper and lower brackets, and between adjacent support risers.

15. The display fixture system in accordance with claim 14 wherein the upper and lower brackets include openings therein, and wherein the removable panel has pins extending therefrom for engagement with the bracket openings.

* * * * *